United States Patent [19]

Aviram et al.

[11] Patent Number: 4,577,983

[45] Date of Patent: Mar. 25, 1986

[54] COLOR-ON-DEMAND RIBBON PRINTING

[75] Inventors: Ari Aviram, Yorktown Heights; Derek B. Dove, Mount Kisco; Ramon Lane, Crompond, all of N.Y.

[73] Assignee: International Business Machines Corporation, Armonk, N.Y.

[21] Appl. No.: 626,162

[22] Filed: Jun. 29, 1984

[51] Int. Cl.[4] ..... B41J 3/20; B41J 35/18

[52] U.S. Cl. ..... 400/120; 400/200; 400/201; 346/76 PH

[58] Field of Search ..... 346/76 PH; 400/120, 400/191, 197, 198, 199, 200, 201, 202, 202.1, 202.2, 202.3, 202.4, 240.3, 240.4; 101/202, 210; 427/141; 118/216, 234, 255

[56] References Cited

U.S. PATENT DOCUMENTS

| | | | |
|---|---|---|---|
| 1,251,691 | 1/1918 | Phelar et al. | 400/202.4 X |
| 3,981,387 | 9/1976 | Gottschlich | 400/201 X |
| 4,153,378 | 5/1979 | Scherrer et al. | 400/202.2 X |
| 4,253,775 | 3/1981 | Crooks et al. | 400/198 |
| 4,329,071 | 5/1982 | Applegate et al. | 400/120 |

FOREIGN PATENT DOCUMENTS

| | | | |
|---|---|---|---|
| 57-72873 | 5/1982 | Japan | 400/120 X |
| 57-15087 | 9/1982 | Japan | 400/120 X |
| 57-140176 | 8/1983 | Japan | 400/120 X |
| 185275 | 10/1983 | Japan | 346/76 PH |
| 185276 | 10/1983 | Japan | 346/76 PH |
| 2100673 | 1/1983 | United Kingdom | 400/120 X |

OTHER PUBLICATIONS

IBM Technical Disclosure Bulletin, vol. 9, No. 3, Aug. 1966, p. 294, "Automatic Ticket Striper", by Davis et al.

IBM Technical Disclosure Bulletin, vol. 23, No. 7A, Dec. 1980, "Color Thermal-Transfer Printing", pp. 2633-2634.

IBM Technical Disclosure Bulletin, vol. 25, No. 11A, Apr. 1983, "Thermal Printer Re-Inking Cartridge", pp. 5814-5815.

*Primary Examiner*—Charles A. Pearson

*Attorney, Agent, or Firm*—Jackson E. Stanland

[57] ABSTRACT

This printing apparatus and technique incorporates a color transfer station to impart a desired color to a fusible ink layer on a ribbon. The color transfer station is located between a supply reel providing the ribbon for printing, and the location where actual printing occurs. This color transfer technique is particularly suitable for use in resistive ribbon thermal transfer printing, where economical use of the ribbon is mandatory. The structure for transferring color to the ink layer of the ribbon utilizes wicks, felt-coated rollers, nozzles, etc., to bring a selected colorant solution into contact with the ink layer of the ribbon, in accordance with the color desired for printing.

8 Claims, 8 Drawing Figures

COLOR-ON-DEMAND RIBBON PRINTING

DESCRIPTION

1. Field of the Invention

This invention relates to ribbon printing in which colors are printed, and more particularly to a ribbon printing system and technique wherein a selected color is applied to a ribbon ink layer prior to transfer of the ink to a receiving medium, in order to provide the selected color in a manner which makes economical use of the ribbon. The invention is particularly suited for that type of thermal transfer printing known as resistive ribbon thermal transfer printing.

2. Background Art

Thermal transfer printing is one type of non-impact printing which is becoming increasingly popular as a technique for producing high quality printed materials. Applications for this type of printing exist in providing low volume printing such as that used in computer terminals and typewriters. In this type of printing, ink is printed on the face of a receiving material (such as paper) whenever a fusible ink layer is brought into contact with the receiving surface, and is softened by a source of thermal energy. The thermal energy causes the ink to locally melt and transfer to the receiving surface. Depending upon the pattern of heat applied to the ink layer, a character, such as a letter or a number, is transferred to the receiving material.

The thermal energy used for thermal transfer printing is supplied from either an electrical source or an optical source, such as a laser. When electrical sources are used, a thermal head can provide the heat to melt the ink layer. An example of a thermal head is one which consists of tantalum nitride thin film resistor elements, such as that described by Tokunaga et al, IEEE Trans. on Electron Devices, Vol. ED-27, No., page 218, January 1980. Laser printing is known in which light from laser arrays is used to provide the heat for melting and transferring the ink to the receiving medium. However, this type of printing is not very popular because lasers providing sufficient power are quite expensive.

Another type of thermal transfer printing, called resistive ribbon thermal transfer printing, also uses a ribbon containing a layer of fusible ink that is brought into contact with the receiving surface. The ribbon includes a layer of resistive material which is brought into contact with an electical power supply and selectively contacted by a thin printing stylus at those points opposite the receiving surface that are desired to be printed. When current is applied, it travels through the resistive layer and provides local heating in order to melt a small volume of the fusible ink layer. This type of printing is exemplified by U.S. Pat. No. 3,744,611. An electrothermal printhead for use in combination with a resistive ribbon is shown in IBM Technical Disclosure Bulletin, Vol. 23, No. 9, February 1981, at page 4305. A technique for reinking a resistive ribbon after it has been used for printing is described by A. Aviram et al, in U.S. Pat. No. 4,268,368.

Several types of resistive ribbons are known in the art, including those which are comprised of a support layer, or substrate, a resistive layer, a thin highly conductive layer serving as a current return layer, and a fusible ink layer. Typically, the fusible ink layer is located at one side of the substrate, while the resistive layer and current return layer are located on the other side of the substrate. In another known type of resistive ribbon, the resistive layer is the support substrate for the fusible ink layer.

Whether it is comprised of an electrically nonconductive or conductive material, the support layer is flexible enough to allow the formation of spools or other "wrapped" packages for storing and shipping. If it is of the nonconductive type, it is usually comprised of a material which does not significantly impede the transfer of thermal energy from the resistive layer on one side of the support layer to the fusible ink layer on the other side. Polymer films are generally used for the support layer. The resistive layer can be comprised of many materials, but is usually comprised of graphite dispersed in a binder. The thin conductive layer is generally comprised of a metal, such as aluminum. The ink layer is comprised of a low melting point polymer binder and a colorant, such as a carbon black. Many ink compositions are described in aforementioned U.S. Pat. No. 4,268,368.

Various techniques for color printing are known in the prior art. These techniques use a ribbon which has multiple colors thereon, a plurality of different colored ink rollers. An example of multi-color printing using a resistive layer is described by A. D. Edgar et al, IBM Technical Disclosure Bulletin, Vol. 23, No. 7A, page 2633, December 1980. The fusible ink layer 5 of this reference uses one or more temperature-sensitive inks and a printing temperature control in order to select the temperature to which the ink layer is heated. Depending upon the temperature, one or two colors are printed. This is a type of color-on-demand system which is somewhat restricted and which requires more extensive electrical circuitry and a more complex thermal head.

Another type of ribbon color printing system is that represented by IBM Product 3287, sold by the International Business Machines Corporation. This is a color accent matrix printer which uses a multi-strike ribbon that has four regions of different colors. When the color of the printing has to be changed, the position of the ribbon is changed to bring the appropriate color portion of the ribbon beneath the printing head. This technique is economical when the ribbon used is of the multi-strike type, but the colored portions of the ribbon can be under-utilized due to the fact that when the black portion is used up, the entire ribbon has to be discarded. An alternative technique that would index each color separtely is not economically feasible because of the need and cost of four separate ribbon drives.

Another type of thermal print system using a thermal transfer ribbon having a repeating series of segments of the three basic colors, yellow, magenta, and cyan, as well as black, is disclosed in U.S. Pat. No. 4,250,511. In that ribbon, the stripes are disposed perpendicular to the ribbon's direction of transport, and they span the whole length of print line, i.e., the whole print media width. The heat-applying printhead is formed by a series of elements arranged in a row transverse to the print media and ribbon transport direction. Each element is connected to a ground lead and to a selection lead. A control means selectively energizes the selected leads. The print media, usually ordinary paper, is pressed against the colored surface of the thermal ribbon by a page-wide roller whose axis is parallel to the print line. The thermal ribbon itself is kept against and supported by the stationary arranged printhead so that the print line is formed by the nip between the printhead and the vacuum roller. Upon printing, any one of the thermal elements may be energized to transfer a spot of a particular color of that color stripe being carried over the head. To permit the deposit of any color at a given location on the print media, the ribbon is advanced at a faster rate than the print media.

References generally describing multicolor recording using ink rollers are Japanese patents 57-72873 and 57-140176, both of which are in the name of M. Sekido. The first of these patents uses an arrangment comprising a plurality of ink rollers, directing rollers, and ink supply containers on a concentric circumference in order to record the three primary colors at the same position. The second of these patents uses a plurality of ink supply rollers 16–18 and a cylindrical ink character body 14 having a plurality of ridges around its periphery. Ink of different colors can be fed into reservoirs located between the ink supply rollers 16–18, and then transferred to the ridges along the periphery of the cylindrical ink carrier body.

Two techniques for reinking a thermal ribbon are descirbed by A. E. Graham et al, IBM Technical Disclosure Bulletin, Vol. 25, No. 11A, page 5814, April 1983, and W. Crooks et al, U.S. Pat. No. 4,253,775. In this patent, a doctor blade 9 is used for supplying ink into the depleted regions 5 of a used ribbon containing an ink layer 3. The resupplying ink can be a liquid ink having a pigment therein, as described in column 4, lines 1–3 of this patent.

In the prior art using ribbons for thermal transfer printing, most colored printing is provided by a prearranged ribbon having the ink colorants already in the ribbon. The use of this ribbon is often uneconomical, espcially when only a single color is utilized for extensive periods of time. While the cost of the ribbon is not a difficult problem in thermal transfer printing of the type using a thermal head (in contrast with resistive ribbon thermal transfer printing), no good technique exists for providing, in an economical way, any desired color at a time just prior to the actual printing operation. The only operation for doing this is the aforementioned IBM Technical Disclosure Bulletin article to A. D. Adgar et al using temperature sensitive inks of different colors.

Accordingly, it is an object of this invention to provide color-on-demand ribbon printing which is economical and does not require the need and cost of multiple ribbon drives or complex thermal heads.

It is another object of this invention to provide color-on-demand printing in resistive ribbon thermal transfer printing.

It is another object of this invention to provide an improved technique for color printing in resistive ribbon thermal transfer printing, where the color printing technique is economical.

It is another object of this invention to provide resistive ribbon thermal printing which allows one to select the desired color prior to the actual printing operation, in order to have economical use of the resistive ribbon.

It is another object of this invention to provide resistive ribbon thermal transfer printing wherein the ribbon can be colored with a selected color over any desired length of the ribbon.

It is another object of the present invention to provide a technique for color-on-demand printing in resistive ribbon thermal transfer printing, where a portion of the ribbon or the entire width of the ribbon can be colored with a selected color.

It is another object of this invention to provide the ability to color any type of ribbon with a selected color and in a selected portion thereof, prior to printing.

It is a further object of this invention to provide ribbon printing techniques having color-on-demand where the ribbon can be toned with a desired color just prior to printing in accordance with desired operator control.

It is another object of this invention to provide a technqiue for color-on-demand resistive ribbon printing using only a single ribbon to provide any desired color.

DISCLOSURE OF INVENTION

This invention relates to a color printing method and apparatus that is particularly suitable for resistive ribbon thermal transfer printing, but which also can be used with thermal head printers. A single ribbon is used in which color is imparted to the ribbon just prior to printing in order to permit economical utilization of the ribbon without increasing the number of ribbon carriers.

In this technique, a ribbon having an ink layer thereon is brought into contact with a color means including a transfer means containing a colorant that is to be added to the ink layer on the ribbon. Means are provided for contacting the ink layer on the ribbon with the transfer medium in order to transfer the colorant to the ribbon just prior to actual printing. In this manner, the color to be imparted is applied to the ribbon over an area of the ribbon correlated to the amount of color printing using that selected color. If printing with another color is subsequently desired, this other color can be imparted to the ribbon in a second color transfer operation.

In selected embodiments, the transfer medium is a wick or felt-type member which receives the proper color solution from an adjacent reservoir of other source of the color. Generally, the ink layer of the ribbon includes all of the ink components with the exception of a colorant (for example, a dye or pigment). By contacting the moving ribbon and the absorbing wick or felt-type material, the colorant in the wick or felt is transferred to the ribbon ink layer. After transfer of the desired colorant to the ink layer, the ink layer is generally heated to remove any residual solvents from the colorant solution. Of course, the ink layer could initially be black, or another color, and then have its color altered by this technique.

These and other objects, features, and advantages will be apparent from the following more particular description of the preferred embodiments.

BEST MODE FOR CARRYING OUT THE INVENTION

Figure 1:
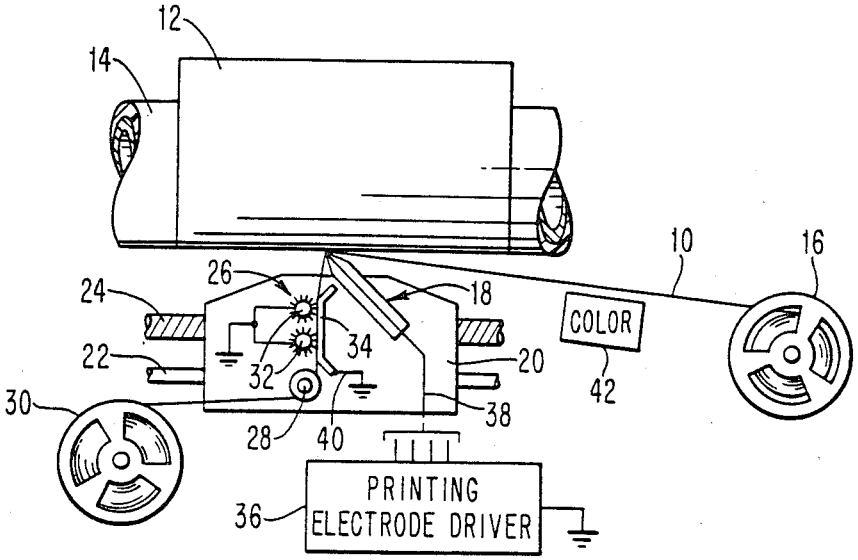
FIG. 1 schematically illustrates a conventional type of printing apparatus including the color-on-demand apparatus of the present invention.

FIG. 1 shows a conventional type of printing apparatus using a ribbon 10 for printing onto a receiving medium, such as paper 12 which is supported by platen 14. Ribbon 10 starts at a supply reel 16 and wraps around a printhead 18 which is mounted on a carrier 20 that is exaggerated in size. Movement of carrier 20 to provide relative printing motion is guided by a rail 22 and controlled by a lead screw 24, as is known in the art.

Ribbon 10 is threaded past a current collection means 26 and is wrapped around a guide roller 28. From the guide roller 28, the ribbon 10 is directed to the takeup reel 30. In this embodiment, current contacting means 26 is a pair of metal roller brushes 32 that are cylindrical in form, such as the type of brushes known for cleaning rifles. Pressure to assure good contact is applied by an opposing pressure pad 34. It should be noted that guide means such as guide roller 28 serves to wrap the ribbon 10 around the printhead 18 to permit convenient access to the surface of ribbon 10 defined by the ink layer of the ribbon which is in contact with the paper 12. This type of apparatus is described more particularly in aforementioned U.S. Pat. No. 4,329,071.

In operation, electrical printing currents are selectively supplied by printing electrode driver 36 via the signal channels 38 to the printhead 18. These currents enter the resistive layer of the ribbon 10 and tend to pass directly to the conducting layer of the ribbon. From the conducting layer of the ribbon, these currents are collected at least in part by the contacting means 26. To assure a current path for startup when no bare areas of the conducting layer of the ribbon may be present, some conducting material, such as carbon, may be provided in the ink layer of the ribbon or an alternate path may be provided using the pressure means 34 with a separate connection 40 to ground. With the connection 40, the current divides between the contacting means 26 and pressure means 34, providing an even lower impedance return path. It is also possible to provide a section at the bginning of the ribbon 10 that does not have the ink layer on it, so that access may be had to the conducting layer for startup.

While the ribbon 10 has been described in the preceding paragraphs as being a resistive ribbon used for resistive ribbon thermal transfer printing, it will be understood that the ribbon can be the type used for printing wherein heat to melt the fusible ink layer is provided by a thermal head, rather than by current flow through the ribbon. However, the primary application of the present invention is in resistive ribbon thermal transfer printing, where no good technique exists for providing color-on-demand printing.

In the printing apparatus of FIG. 1, a color-on-demand apparatus means 42 is provided. This apparatus is the means by which a desired color is imparted to ribbon 10, just prior to the printing (ink transfer) operation. Thus, coloring means 42 is located between the supply reel 16 and the printhead 18.

Figure 2:
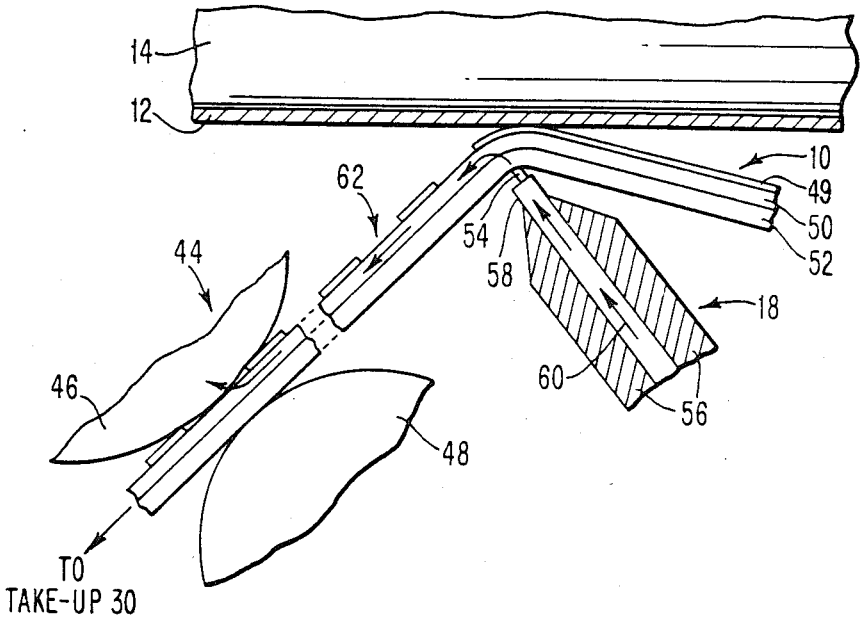
FIG. 2 is an expanded view of a portion of the apparatus of FIG. 1, and in particular illustrates the printing operation using a resistive ribbon 10, which has had a selected color imparted to it by the technique of the present invention.

FIG. 2 is an expanded view of a portion of the apparatus of FIG. 1, and in particular illustrates the printing operation. In FIG. 2, the current return path utilizes a contacting means 44 which is different than the contacting means 26 of FIG. 1. Contacting means 44 is comprised of a conductive roller 46 and a pressure roller 48. Contacting roller 46 can be comprised of an electrically conducting rubber that deforms under pressure from the opposing roller 48 in order to enter voids in the ink layer of the ribbon.

The ribbon 10 in this embodiment is comprised of three layers: an outer ink transfer layer 49, a resistive layer 50 having a moderate resistance (e.g., 200–1000 ohms/sq., and an intermediate contacting layer 52. This type of ribbon is well known in the art, and is used in cooperation with a printhead 18, comprising a set of electrodes 54, where the printhead 18 includes clamping blocks 56 between which an insulating pad 58 and the set of electrodes 54 are pressed. The printing current flow is indicated by the arrows 60. During printing the electrodes 54 swipe across the ribbon 10 which is pressed against the paper surface 12 supported by platen 14. Current enters the ribbon through resistive layer 52 and tends to flow directly to the conducting layer 50 which is greatly exaggerated in thickness in this figure. At least a portion of the current is collected for return by direct contact with the conductive layer 50 through the ink layer side of the ribbon 10. This direct contact enables the conducting roller 46 to enter voids 62 in the printing ribbon in order to establish electrical contact with the conductive layer 50. While it is not shown in FIG. 2, a return path connection from roller 46 to the current source (not shown) is also provided.

Figure 3:
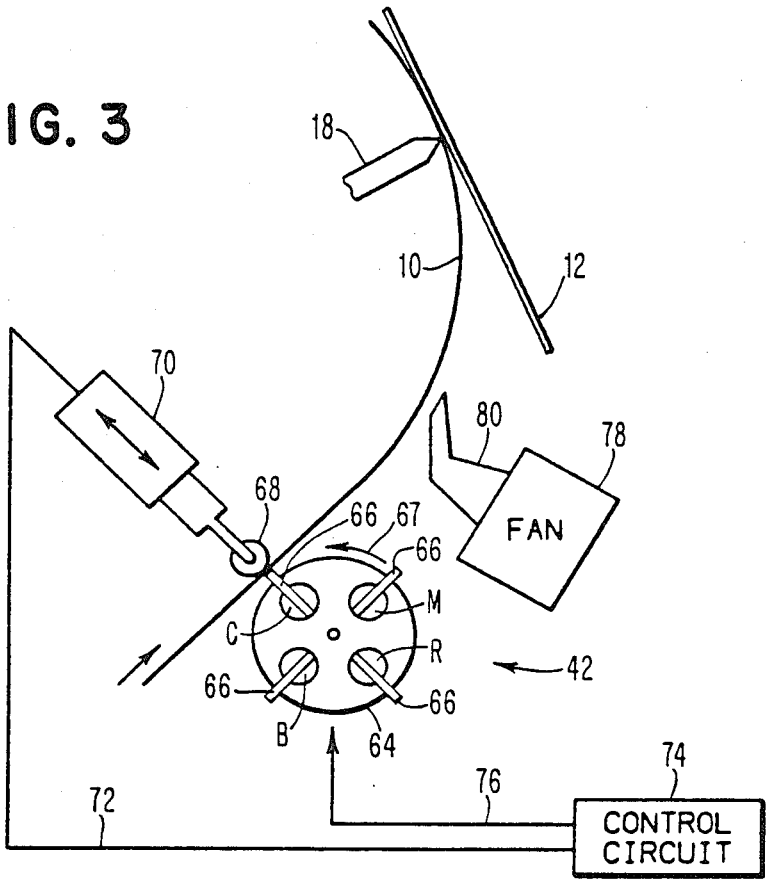
FIG. 3 schematically illustrates one embodiment for a color-on-demand apparatus in accordance with the present invention.

FIG. 3 represents one embodiment for the coloring means 42 which was schematically illustrated in FIG. 1. In order to relate FIG. 3 to the more complete apparatus of FIG. 1, the same reference numerals are used for the ribbon 10, paper 12, and printing head 18.

In more detail, color means 42 is comprised of a carousel-like device 64 which includes a plurality of colorant reservoirs B, R, M, and C containing solutions of the colors black, red, magenta and cyan, respectively. Wicks 66 are located in each of the reservoirs to absorb the colorant solution therein for later transfer to the ink layer of ribbon 10. Carousel device 64 is rotatable in the direction of the arrow 67 to bring a wick 66 associated with a selected color to a location which is opposite the pressure roller 68 which is connected to the actuator 70. Depending upon the presence of an electrical control signal on conductor 72, actuator 70 is used to move the pressure roller 68 into contact with the back of ribbon 10. This deflects the ribbon into contact with the wick 66 that has been brought to a position on the ink side of ribbon 10 directly opposite the pressure roller 68. The color from the associated colorant reservoir will be transferred to the ink layer of ribbon 10 by the contact of the wick 66 and the ink layer. Any length of ribbon 10 can be colored with the selected color, depending upon the signal provided by the control circuit 74 to the motor 84 (FIG. 4) attached to the carousel device 64. The signal for movement of carousel device 64 is provided along conductor 76.

After the ribbon 10 is toned by the addition of a colorant thereto, it passes a heater fan 78 which has a duct 80 attached thereto. Fan 78 provides a flow of heated air through duct 80 onto the color-toned ink layer of ribbon 10, in order to remove any residual solvents resulting from the color-adding operation.

Figure 4:
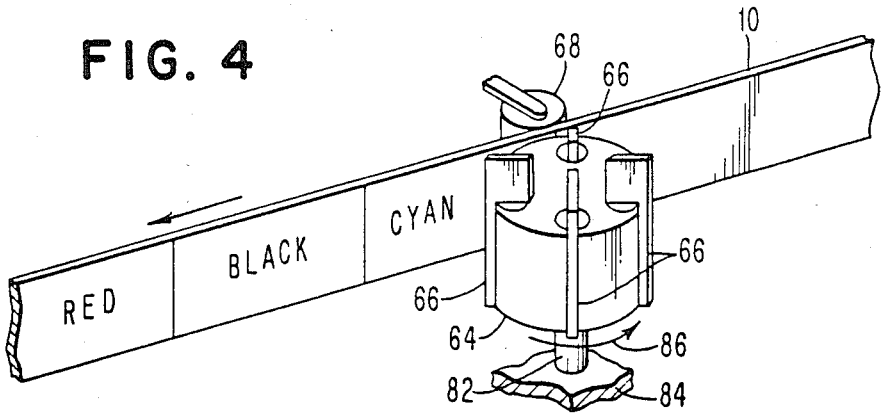
FIG. 4 shows in another view more detail of a portion of the apparatus of FIG. 3.

FIG. 4 presents more detail of a portion of the apparatus of FIG. 3, and particularly shows the carousel device 64 and the wicks 66. Carousel 64 is attached to a shaft 82 which in turn is connected to a motor 84, only a portion of which is shown. This motor could be, for example, a stepping motor of any type well known in the art which advances a set amount in response to a control signal.

FIGS. 5–8

These figures illustrate another embodiment for the color means 42, and in particular another type of device for transferring a colorant solution to the ribbon 10.

Figure 5:
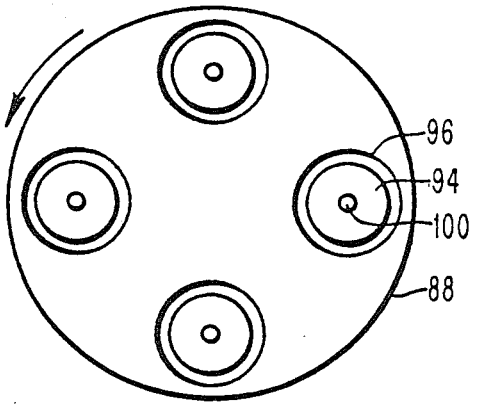
FIGS. 5–8 schematically illustrate various features of another embodiment for a color-on-demand apparatus in accordance with the present invention.
Figure 6:
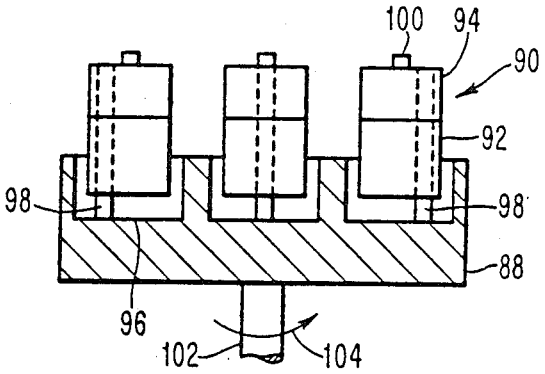

In more detail, FIGS. 5 and 6 are top and side views, respectively, of a carousel-type of device 88 that is used to house containers 90 having the colorant solution therein. Each container 90 has a bottom portion 92 and a top lid 94 which is used to prevent evaporation of the colorant solution at those times when that particular color is not being transferred to the ribbon. Each of the containers 90 is located in a recessed portion 96 of the carousel 88 and includes a roller 98 having a felt-like coating thereon which absorbs the colorant solution. The rollers 98 are attached to carousel 88 in such a manner in that they can rotate easily when contacted by the ribbon 10. For example, roller 98 can be bearing-mounted in the carousel 88. During transfer of color from the felt layer on roller 98 to the ribbon 10, there will be substantially zero relative velocity between the roller 98 and the ribbon 10.

Figure 8:
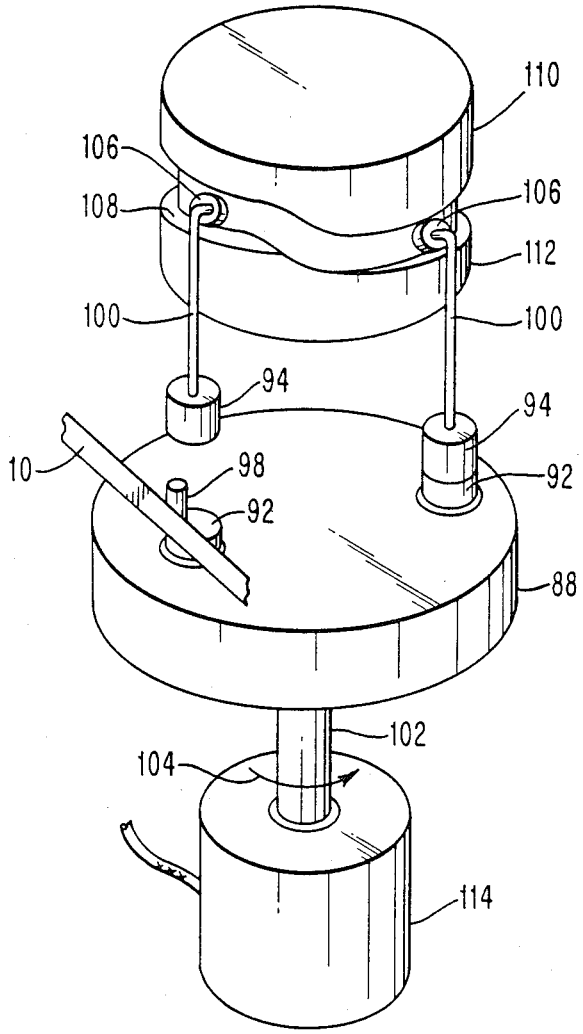

As will be more apparent from FIG. 8, each of the lids 94 of the containers is attached to a shaft 100, which causes the lid 94 to be raised or lowered into contact with the bottom portion 92 of the containers. This prevents evaporation of the coloring solution in the containers. Carousel 88 is connected to a motor (FIG. 8) via a shaft 102. This allows the carousel to be stepped in the direction of arrow 104, in accordance with the color which is desired to be imparted to the ribbon.

Figure 7:
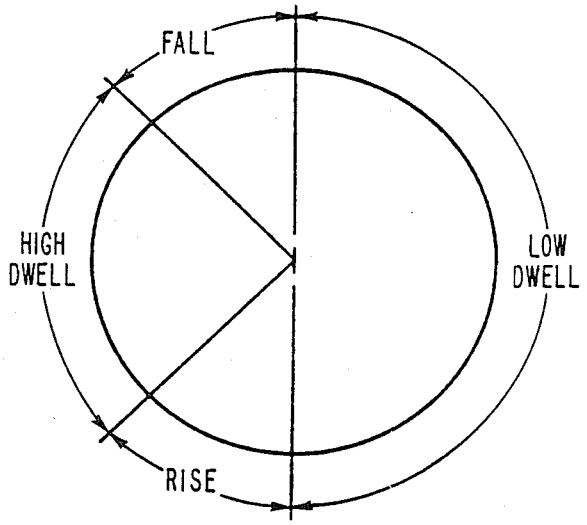

As mentioned previously, container lid 94 keeps the container closed at those times when the colorant solution in the associated reservoir is not needed. In order to accomplish this, means is provided for raising and lowering the container lids 94, This is shown more clearly in FIG. 8, while FIG. 7 illustrates the timing sequence that is followed as the carousel 88 rotates. Referring to FIG. 8, the same reference numerals are used whenever possible to coordinate FIGS. 5–8. Accordingly, container lids 94 are raised and lowered by the attached shafts 100, which are connected to rollers 106 that follow a cam track 108 defined by the upper and lower can surfaces 100 and 112, respectively. Movement of carousel 88 is by the stepping motor 114, which is attached to carousel 88 by shaft 102.

In FIG. 8, only two colorant solution containers are shown for ease of illustration. For the left-most container of this figure, lid 94 is raised to be out of contact with the lower half 92 of the container. This exposes the felt layer on roller 98 so that it can be contacted by the ribbon 10 in order to tranfer colorant solution from container portion 92 to the ribbon 10. Since the other container in this figure is not being used for the color transfer operation, lid 94 is in contact with the bottom portion 92 of the container. This occurs when the attached wheel 106 is in a lower portion of the cam track 108.

FIG. 7 illustrates the movement of wheels 106 along the cam track 108 as the carousel 88 rotates. During most of the rotation of carousel 88, a wheel 106 attached to any container lid 94 will be in a position of low dwell in the cam track and will maintain the associated container closed. Just prior to the movement of this container to a position where color transfer will occur, the container lid 94 will begin to rise to a position of high dwell. This position can be adjusted for any length of time in accordance with the control provided to the stepping motor 114. When the container lid 94 is moved away from lower container portion 92, the roller 98 will be exposed and can be contacted by the ribbon 10. After the color transfer is complete, carousel 88 will rotate and wheel 106 will begin to move downwardly along track 108 to provide the "fall" portion of the cycle.

As an example, color toning in accordance with the present invention has been achieved in an ink layer of 5 microns thick of Macromelt 6203 (a trademark of Henkel Co.). This ink layer was subsequently toned with color marker ink made by Rowe Company and used in printing experiments on a resistive ribbon thermal transfer printer. To improve the color spreading, micron size particles of $TiO_2$ were incorporated in the clear ink layer on the ribbon. The color of the film became white with the addition of these particles and was sandy. The rough surface of the ink layer was receptive to coloration and provided even coatings. The original white appearance of the ink layer did nothing to alter the good color printing results that were obtained. Another suitable roughening particle that can be added to the ink layer is silica.

The need for a roughening (matting) agent to insure uniform coloration of the ink layer in the ribbon is more necessary with the type of color means 42 shown in FIGS. 3 and 4. This is because of the "smearing" action that exists in the moving ribbon and the relatively stationary wick 66 which contacts it in order to transfer color to the ribbon. However, in the embodiment of FIGS. 5–8, wherein a cylindrical, rotatable roller 98 is used, it is not necessary to add a matting additive to the uncolored ink layer on the ribbon. Uniform coloration results when the cylindrical roller is free to rotate when contacted with the moving ribbon wherein essentially zero velocity exists between the ribbon and the roller 98.

Coloration of the ink may be applied a line at a time or in short sections as required during printing. For example, when a printer is to operate in a typewriter mode, there is considerable start-stop operation. Color toning of the ribbon can occur when the carriage is returning. In this way, the ribbon will be toned with the proper color for printing of the next line on the paper. On the other hand, when the printer is operating in a conventional printing mode, the ribbon moves at generally constant velocity. It is easier to uniformly color the ribbon when it moves at a constant velocity.

Multicolors within a line can also be achieved with this tyep of color transfer. For example, when a printer is operating in a typewriter mode, different colors can be applied to the ribbon during the carriage return. Also, several passes over a line may be made to superimpose colors in order to obtain a wider range of colors than those supplied by the inking station (comprised of the ink reservoirs and transfer media). For example, a new color can be added to the same portion of the ribbon during separate carriage returns, there being no printing until all of the colors have been added to the same portion of the ribbon. In this operation, the ribbon would be moved to the same starting point each time. As an alternative, multiple transfer media can contact the ribbon at the same time.

In the practice of this invention, the good erasure properties inherent in resistive ribbon thermal transfer printing are not altered, and all other features of this type of printing can be maintained.

While the invention has been described with respect to specific embodiments thereof, it will be apparent to those of skill in the art that variations can be made therein without departing from the spirit and scope of the present invention. For example, other techniques for applying the colorant solution to the ribbon can be undertaken, and the color applying means can use multiple wicks, etc. which contact the ribbon at the same time. Further, it is also within the scope of this invention to provide a nozzle-type of apparatus for uniformly applying the colorant solution to the ribbon, just prior to actual printing.

What is claimed is:

1. A color-on-demand resistive ribbon printing apparatus including in combination:

a ribbon including a resistive layer and having a fusible ink layer thereon, said ink layer including all of the ink components with the exception of a desired colorant, color means for applying said desired colorant to said fusible ink layer, said color means being located between a supply reel supplying said ribbon and a printing head for melting said fusible ink layer, said color means containing a colorant solution and a transfer means for transferring said colorant solution to said ribbon, said color means further including contact means for contacting said ribbon and said transfer means to transfer said colorant solution to said fusible ink layer on said ribbon, and said printing head including a plurality of electrical current carrying styli for printing onto a receiving medium colored indicia using said colored ribbon.

2. The apparatus of claim 1, in which said transfer means is comprised of an absorbing material having said colorant solution absorbed into it from a reservoir containing said colorant solution.

3. The apparatus of claim 2, wherein said color means includes a carrier for a plurality of color-solution reservoirs, each of which has a transfer means associated therewith, there being means for moving said carrier to bring a selected one of said transfer means into a position of proximity to said ribbon.

4. The apparatus of claim 3, where each of said reservoirs includes a cap for preventing evaporation of said colorant solution therefrom, and means for removing said cap when said ribbon and selected one of said transfer means are to be in contact with one another.

5. The apparatus of claim 4, where said carrier is rotatable about an axis therethrough, to bring a selected one of said transfer means to a position where it can be contacted by said ribbon.

6. The apparatus of claim 3, further including control means for moving said carrier and for determining the amount of time a selected transfer means and said ribbon are in contact with one another.

7. The apparatus of claim 1, where said transfer means is a roller having an absorbing material thereon which is free to rotate and be driven by said ribbon when said roller is in contact with said ribbon.

8. The apparatus of claim 7, wherein there is substantially zero velocity between said ribbon and said transfer means when said ribbon and said transfer means are in contact with one another.

* * * * *